United States Patent [19]

Swadell

[11] Patent Number: 4,930,055

[45] Date of Patent: May 29, 1990

[54] MARKER LAMP WITH HALO EFFECT

[75] Inventor: Robert A. Swadell, Henderson, Nev.

[73] Assignee: Geisha Corporation, Henderson, Nev.

[21] Appl. No.: 360,171

[22] Filed: Jun. 10, 1989

[51] Int. Cl.[5] ..... F21V 5/00

[52] U.S. Cl. ..... 362/244; 362/245; 362/329; 362/339; 362/806; 264/177.16

[58] Field of Search ..... 362/240, 244, 245, 249, 362/329, 339, 340, 431, 806; 264/177.1, 117.16

[56] References Cited

U.S. PATENT DOCUMENTS

| | | | |
|---|---|---|---|
| 1,149,208 | 8/1915 | Mygatt | 362/340 |
| 1,457,980 | 5/1923 | McMasters | 362/339 |
| 2,196,214 | 4/1940 | Kantack | 362/806 |
| 2,764,670 | 9/1956 | Van Dusen, Jr. | 362/431 |
| 3,777,138 | 12/1973 | Metzler | 362/431 |
| 4,285,032 | 8/1981 | Honda et al. | 362/240 |
| 4,345,363 | 8/1982 | Leuchs et al. | 264/177.1 |
| 4,536,362 | 8/1985 | Donaldson | 264/117.16 |
| 4,781,880 | 11/1988 | Robbins | 264/177.1 |

*Primary Examiner*—Ira S. Lazarus
*Assistant Examiner*—Alan Cariaso
*Attorney, Agent, or Firm*—Sughrue, Mion, Zinn, Macpeak & Seas

[57] ABSTRACT

A marker lamp having a transparent cylindrical tube in which are mounted a plurality of incandescent filament-type bulbs spaced along the longitudinal axis of the tube. Either the outer or inner surface of the tube has straight striations or grooves extending longitudinally of the tube. When the bulbs are illuminated, there is formed in the tube a light halo centered on each bulb and lying in a plane perpendicular to the longitudinal axis of the tube.

11 Claims, 3 Drawing Sheets

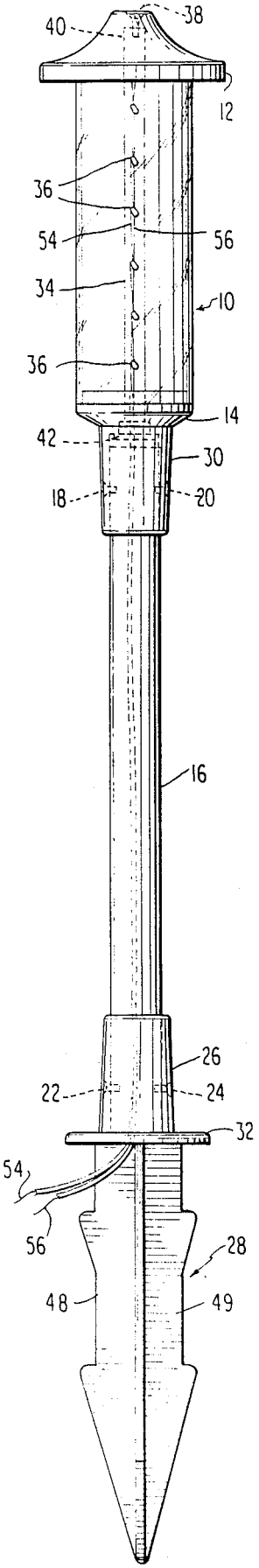
FIG. 1
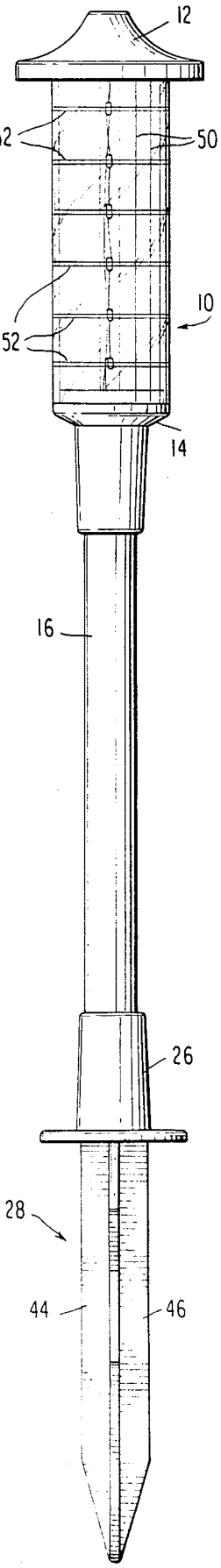
FIG. 2
FIG. 3
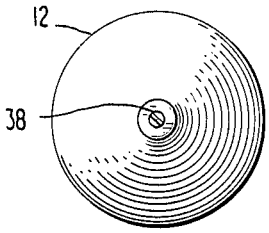
FIG. 4
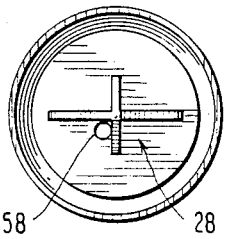

FIG. 8
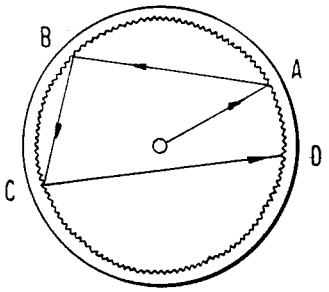
FIG. 10A
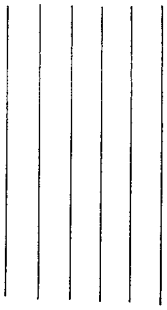
FIG. 10B
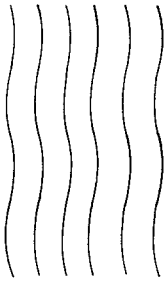
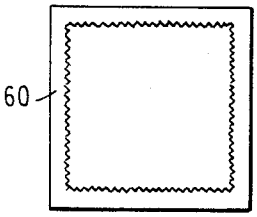
FIG. 11A
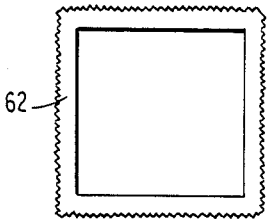
FIG. 11B
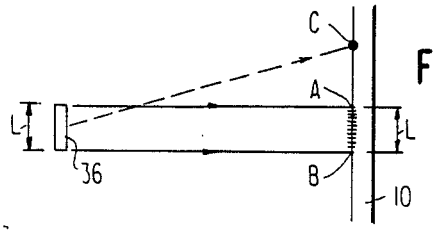
FIG. 9
FIG. 12
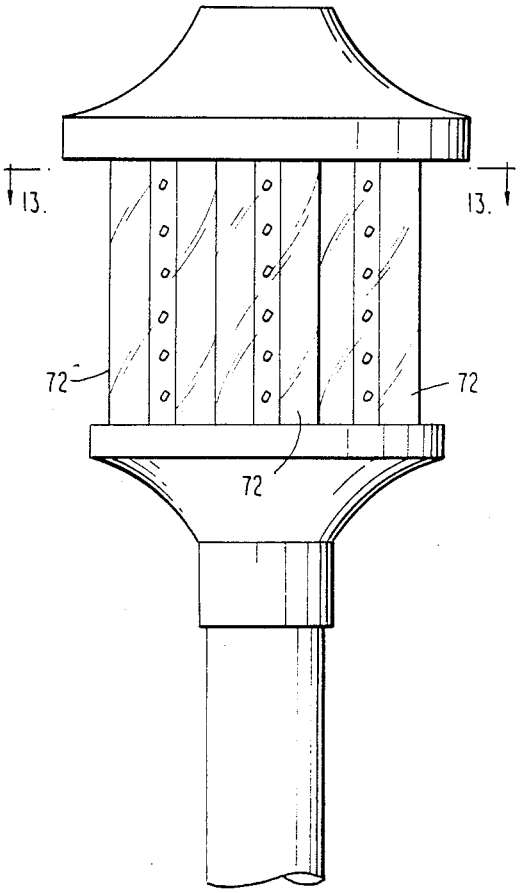
FIG. 13
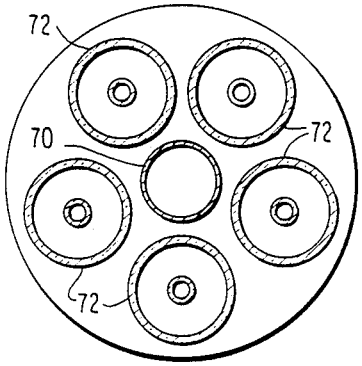

MARKER LAMP WITH HALO EFFECT

BACKGROUND OF THE INVENTION

1. Field of the Invention

My invention relates generally to the field of decorative lamps and, more particularly, to an improved marker lamp which, when illuminated, presents a halo effect to an observer. My invention also relates to a method of making such a marker lamp with a halo effect.

2. Description of the Prior Art

There is known in the prior art a marker lamp containing an incandescent light bulb, but such a lamp presents to the observer only the image of a point source of light corresponding to the glowing filament of the incandescent bulb.

SUMMARY OF THE INVENTION

A primary object of my invention is to provide a marker lamp having a construction which optically presents halos, i.e. narrow circular rings of light to an observer.

Another object of my invention is to provide a method of extruding a transparent tube which will provide a halo effect when illuminated by one or more incandescent lamps disposed inside the tube.

BRIEF DESCRIPTION OF THE DRAWING

FIG. 1 is a front elevational view of a preferred embodiment of my invention.

FIG. 2 is a side elevational view.

FIG. 3 is a top view.

FIG. 4 is a bottom view.

FIGS. 5–9, 10A, 10B, 11A, and 11B are schematic diagrams indicating a theory of the optics involved in producing the halo effect.

FIG. 12 is an elevational view of another embodiment of the invention.

FIG. 13 is a horizontal cross-section taken along line 13—13 of FIG. 12.

DETAILED DESCRIPTION OF PREFERRED EMBODIMENTS

Figure 1A:
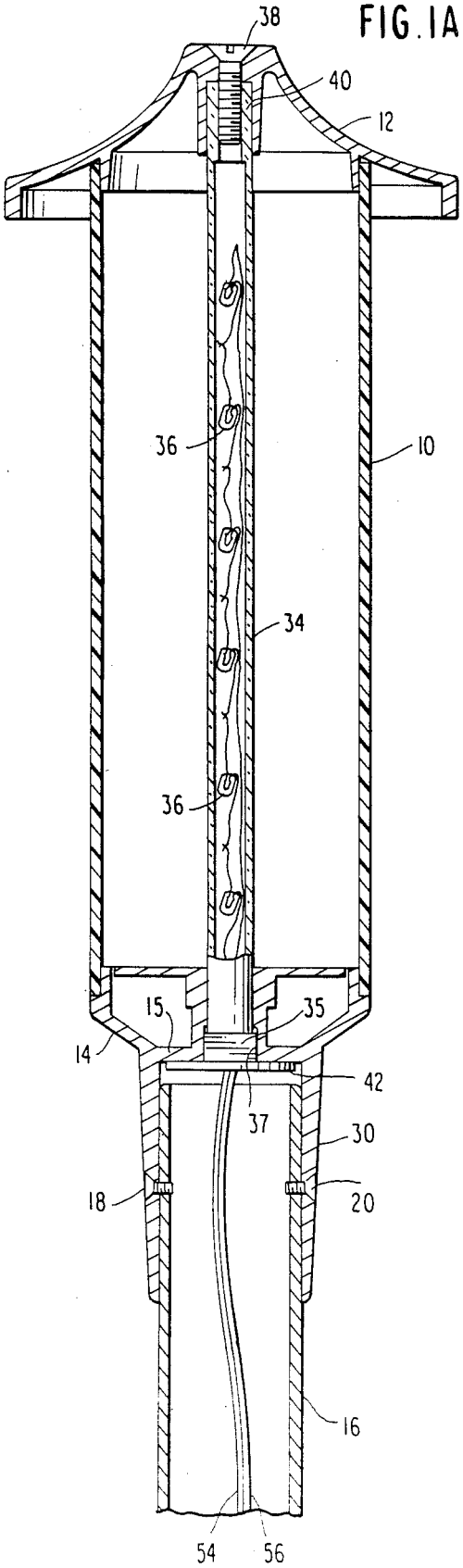
FIG. 1A is an enlarged vertical cross-section of the upper portion of the preferred embodiment.

FIGS. 1–4 illustrate a preferred embodiment of my invention. A transparent plastic tube 10 is clamped between an upper flanged cap 12 and a lower flanged cap 14 which is fixed to the upper end of a support tube 16 by diametrically opposed screws 18 and 20. The lower end of support tube 16 is fixed by diametrically opposed screws 22 and 24 to an upper sleeve portion 26 of a ground spike 28. While the support tube 16 is straight-walled or cylindrical, a lower tubular portion 30 of flange 14 is downwardly convergent, and the upper sleeve portion 26 of spike 26 is downwardly divergent. As a result, the support 16 is held by friction in both the tubular portions 26 and 30, and locked therein by the screws 18, 20, 22 and 24. A flange portion 32 of spike 28 engages the surface of the ground when the spike is fully inserted into the ground.

Fixedly mounted within the transparent tube 10 is a smooth-surfaced, smaller diameter transparent tube 34 in which is mounted a vertical string of six spaced miniature incandescent light bulbs 36. A screw 38 threads into a solid upper portion 40 of tube 34 for clamping the outer tube 10 between the cap 12 and the flange 14. The inner tube 34 has at its lower end a flange portion 42 which abuts the underside of a horizontal wall 15 formed in flange 14, as best seen in FIG. 1A.

In order to prevent the rotation of tube 34 while screw 38 is threaded into portion 40, the lower end of tube 34 is provided with a square portion 35 which is located just above flange 42 and which fits into a square bore 37 provided in the underside of wall 15.

Spike 28 has two vertically extending straight side walls 44 and 46, and also two vertically extending side walls 48 and 49 having downwardly tapered edges which facilitate insertion of the spike 28 into the ground, while at the same time resisting upward movement of the spike.

An important feature of my invention is that the transparent outer tube 10 has in either its inner and outer surface closely spaced striations or grooves 50 which extend parallel to the longitudinal axis of the tube. These striations or grooves are closely spaced in the peripheral direction and, preferably, are contiguous to each other, thereby forming in transverse cross-section a sawtooth configuration. I have found that, when the six filament-type incandescent lamps or bulbs 36 are illuminated, six distinct halos 52 or rings of light are formed in the transparent tube 10, and that a filament of a lamp is at the center of each halo or ring (FIG. 2). The vertical spacing of the halos is the same as that of the lamp filaments and the vertical height of each halo appears to correspond to the illuminated filament of each incandescent bulb 36. Each halo is in a plane perpendicular to the longitudinal axis of the outer tube 10. One observing the marker lamp when the incandescent bulbs 36 are illuminated, sees the six distinct halos 52 of light formed in the outer tube 10, and also sees through the halo a higher intensity light from the filament of the bulbs 36. The result is a highly unique and decorative effect.

The incandescent light bulbs 36 are connected in series via wires 54 and 56 which, at the lower portion 42 of inner tube 34, are insulated by a conventional plastic insulating material and located by embedding in the lower portion 42. The insulated wires extend vertically downward through the support tube 16 and emerge into the outside world through a hole 58 in the flange 32 of spike 28. The external ends of wires 54 and 56 may be connected through a twenty-four volt transformer to a conventional 110 to 120 volt house current supply, whereby twenty-four volts are applied across the string of six incandescent lamp bulbs 36 so that four volts are applied across each bulb. The smooth-surface inner tube 34 and the striated-surface outer tube 10 are made from a polycarbonate resin, more specifically that sold under the trademark LEXAN of the General Electric Company. I purchased long lengths of small diameter tubes from which I cut to length the inner tubes 34. For the outer tube 10, I bought LEXAN pellets, heated them in a conventional extruder, and formed an extruded outer tube 10. I found that, by roughening the surface of either the inner or outer die of the extruder, I formed the straight striations or recesses 50 on either the inner or outer surface, respectively, of the outer tube 10. I found that by varying the roughness, I correspondingly varied the peripheral spacing and radial depths of the striations or grooves 50. As a practical matter, the striations or grooves were peripherally contiguous, and I varied the radial depths of the striations or grooves until I obtained the sharpest or highest intensity of halos or rings of light 52. This is the manner in which I discovered or made my invention, and I found that any radial depth provided the "halo" effect, and it was only the sharpness and/or intensity of the halo which varied with the degree of roughness or depth of grooves.

The following is a possible explanation of the theory of operation of my invention, assuming the striations or grooves 50 are formed on the inner surface of the outer tube 10 (FIG. 2). This explanation uses only the "geometrical optics" theory, involving Snell's Law. The more exact theory of diffraction is not needed since the wavelength of the light is very much smaller than the physical dimensions of the features of the marker lamp. (FIG. 5)

Figure 6:
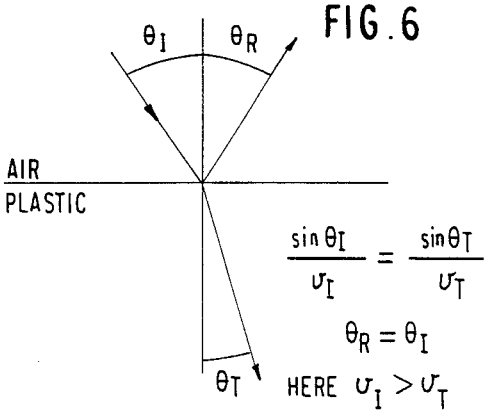

For homogeneous materials, the light rays are straight lines and obey Snell's Law when passing from one medium to another with different velocity (v) of the light (see FIG. 6 and equations).

Figure 7:
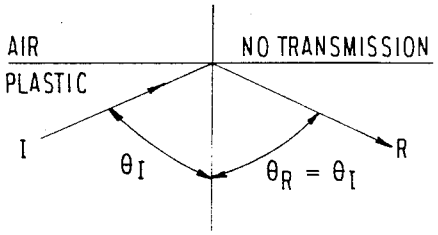

When a ray is going from the plastic tube 10 to the air (FIG. 7), total reflection will occur when $\theta_I$ becomes sufficiently large, since $\theta_T = v_T/v_I \sin\theta_I$ and $v_T/v_I > 1$; hence, when $\sin\theta_T > 1$, there is no transmission into the air, only reflection. Here, $v_T$ is the velocity in air, and $v_I$ is the velocity in the plastic. This is the basis for a "waveguide" or "wave duct" where the waves are "trapped" and remain always inside, e.g. as used in radar. A high intensity will be attained inside. (FIG. 7).

Figure 5:
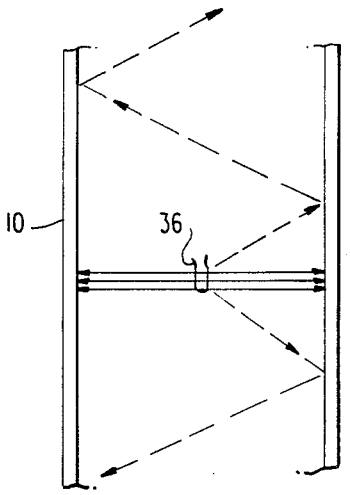

In FIG. 5, it is clear that any ray which issues from any point of the lighted filament 36 and which is not "horizontal" (i.e. perpendicular to the wall of tube 10) will be reflected many times up (or down) and will be lost (shown in dotted lines). However, the "horizontal rays" (solid lines) will be "trapped" and will always be reflected in their same plane. This region is bounded by the upper and lower horizontal arrows in FIG. 5.

At each point where reflection occurs (such as A, B, C, D in FIG. 8), there will also be some light transmitted into the plastic (FIG. 6). Sometimes, the transmitted ray at A, B, C, D, etc. will reach the smooth outside surface of the plastic and be "trapped", with no transmission to the outside (FIG. 7). Thus, the plastic acts as a waveguide, and a high intensity of light can be built up inside it. All these are "horizontal". The inner wall, in addition to having the large-scale striations, grooves or notches 50, is also slightly "rough" so that it can be considered slightly to be a "frosted glass" surface. Therefore, when a high-intensity ray (trapped) hits it from inside, the surface will act as a secondary source of emission, which is what the eye sees as a bright band or halo of incoherent light at a fixed position in the plastic. Any non-horizontal ray (dashed line) which hits at C has low-intensity and, hence, is not seen as the bright band AB is seen. (FIG. 8 and 9).

If there were no grooves or striations, the rays from the filament would pass directly through the plastic tube and perpendicular to it, and the direct image of the bulb 36 and its filament would be seen as coherent light, with no halo or circular light-ring existing.

It is obvious that the device will work only if the grooves are straight vertically (FIG. 10A), i.e., are not wavy (FIG. 10B), in order for the horizontal rays to stay "trapped".

All of the "horizontal" rays from the filament will eventually penetrate into the plastic (although it may take some multiple reflections to accomplish this). However, because of the "trapping" waveguide effect, the light (incoherent) which finally leaves the transparent plastic tube is a relatively smaller fraction of the rays inside. However, the intensity of the trapped rays is very high (although not visible to an observer), and therefore power balance in the steady-state case will be attained.

The high-intensity in the waveguide is developed at the starting transient when the filament is first turned on; i.e. most of the initial power enters, but only a small fraction leaves the guide. Energy balance in the steady-state is obtained by (filament power)(high entrance transmission)=(very high waveguide power)(low exit transmission).

A similar theoretical explanation could be given for the case where the striations or grooves are on the outside of the outer tube 10 and where the inner surface of the tube is smooth. My trial and error process confirms that no halo is formed when both the inner and outer surfaces of the outer tube 10 are smooth. Furthermore, I found that as I increased the roughness of the extruder die, the sharpness and intensity of the halo increased only up to a certain point, after which the tube became translucent (i.e. less transparent), thereby destroying the desirable ornamental effect of my marker lamp with halo effect. Thus, in order to practice my invention, one skilled in the art would have to follow my own procedures, i.e. by trial and error adjusting the depths of the striations or grooves until the maximum desired halo effect is obtained.

Even though in the preferred form of the embodiment the outer tube 10 is cylindrical, it may also be a square tube, such as a tube 60 with striations on the inner surface thereof as shown in FIG. 11A, or a square tube 62 with striations on the outer surface thereof as shown in FIG. 11B.

FIGS. 12 and 13 illustrate another embodiment of my invention wherein a plurality of marker lamps, as illustrated in FIGS. 1–4, are mounted in a post lamp fixture around an optional central reflector 70. In the illustrated embodiment, there are five individual marker lamps 72, each being of the same general configuration as the upper part of the marker lamp illustrated in FIGS. 1–4. One still observes the halos in the individual lamps, but also observes other unique images because of the interaction of the reflected waves from the reflector 70. When the reflector 70 is removed, there is also an optical interaction among the light rays emitted from the individual marker lamps.

Spike 28 is made from ABS (acrylonitrile-butadiene-styrene) purchased from Borg Warner and bearing the trademark CYCOLAC.

What is claimed is:

1. An electric lamp comprising:

an elongated transparent tube having a transparent wall;

a plurality of incandescent, filament-type bulbs mounted within said tube and spaced substantially along the longitudinal axis thereof; and straight, longitudinally extending striation means, in one of the inner and outer surfaces of said tube, for forming inside said transparent wall, when said bulbs are illuminated, a plurality of corresponding halos centered on the bulbs and lying in respective planes perpendicular to said longitudinal axis.

2. An electric lamp as defined in claim 1, wherein said tube is cylindrical and has a circular transverse cross-section.

3. An electric lamp as defined in claim 1, wherein said tube has a rectangular transverse cross-section.

4. An electric lamp as defined in claim 1, wherein the striation means comprises a plurality of striations in the inner surface of said tube.

5. An electric lamp as defined in claim 1, wherein the striation means comprises a plurality of striations in the outer surface of said tube.

6. An electric lamp as defined in claim 1, comprising additional transparent tubes like said transparent tube, and each containing a plurality of said incandescent filament-type bulbs mounted therein, all of the tubes being arranged around a central reflector.

7. A method of making an electric lamp having: an elongated transparent tube having a transparent wall; at least one incandescent, filament-type bulb mounted within said tube substantially on the longitudinal axis thereof; and straight, longitudinally extending striations, in one of the inner and outer surfaces of said tube, for forming inside said transparent wall, when said bulb is illuminated, a halo centered on the bulb and lying in a plane perpendicular to said longitudinal axis;

said method comprising:

extruding a clear plastic resin through an extruder to form said tube;

roughening a surface of the extruder to form longitudinal striations in a surface of the transparent wall of the tube; and increasing the roughness until the depth of the striations is such as to produce maximum intensity and sharpness of the halo produced when the bulb is illuminated.

8. An electric lamp as defined in claim 1, wherein said striation means extends along the full length, and around the entire periphery, of said tube.

9. An electric lamp as defined in claim 5, wherein said striations extend along the full length, and around the entire periphery, of said tube.

10. An electric lamp as defined in claim 6, wherein said striations extend along the full length, and around the entire periphery, of said tube.

11. A method as defined in claim 7, wherein the striations are formed along the full length, and around the entire periphery, of the tube.

* * * * *